US009968823B2

(12) United States Patent
Cutler

(10) Patent No.: US 9,968,823 B2
(45) Date of Patent: May 15, 2018

(54) TREADMILL WITH SUSPENDED TREAD BELT

(71) Applicant: ICON Health & Fitness, Inc., Logan, UT (US)

(72) Inventor: Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days. days.

(21) Appl. No.: 15/246,043

(22) Filed: Aug. 24, 2016

(65) Prior Publication Data

US 2017/0056716 A1 Mar. 2, 2017

Related U.S. Application Data

(60) Provisional application No. 62/211,580, filed on Aug. 28, 2015.

(51) Int. Cl.

| | |
|---|---|
| ***A63B 22/00*** | (2006.01) |
| ***A63B 22/02*** | (2006.01) |
| *A63B 69/16* | (2006.01) |
| *A63B 71/06* | (2006.01) |
| *A63B 21/02* | (2006.01) |

(52) U.S. Cl.

CPC ..... *A63B 22/0285* (2013.01); *A63B 22/0046* (2013.01); *A63B 22/02* (2013.01); *A63B 21/023* (2013.01); *A63B 22/0023* (2013.01); *A63B 22/0207* (2015.10); *A63B 22/0235* (2013.01); *A63B 69/16* (2013.01); *A63B 71/0622* (2013.01); *A63B 2071/0625* (2013.01); *A63B 2071/0638* (2013.01); *A63B 2220/806* (2013.01); *A63B 2220/808* (2013.01); *A63B 2225/50* (2013.01); *A63B 2230/01* (2013.01); *A63B 2230/06* (2013.01); *A63B 2230/207* (2013.01); *A63B 2230/30* (2013.01); *A63B 2230/40* (2013.01); *A63B 2230/60* (2013.01)

(58) Field of Classification Search

None

See application file for complete search history.

(56) References Cited

U.S. PATENT DOCUMENTS

| | | | | |
|---|---|---|---|---|
| 3,608,898 A | | 9/1971 | Berlin | |
| 3,642,279 A | * | 2/1972 | Cutter | A63B 22/02 482/54 |
| 3,689,066 A | | 9/1972 | Hagen | |
| 3,901,379 A | | 8/1975 | Bruhm | |
| 4,024,949 A | | 5/1977 | Kleysteuber et al. | |
| 4,548,405 A | * | 10/1985 | Lee | A63B 22/02 482/26 |
| 4,614,337 A | | 9/1986 | Schonenberger | |
| 4,938,473 A | | 7/1990 | Lee et al. | |

(Continued)

*Primary Examiner* — Stephen R Crow

(74) *Attorney, Agent, or Firm* — Holland & Hart LLP

(57) ABSTRACT

A treadmill deck may include a first side rail, a second side rail aligned with the first side rail, a first pulley connected to a first end of the first and second side rails, and a second pulley connected to a second end of the first and second side rails. A tread belt is disposed around the first pulley and the second pulley. Further, a first cover is connected to the first rail that spans at least a first portion of a first mid-region of the first rail and cantilevers over a portion of the tread belt that provides an unstable footing. Also, the tread belt moves with respect to the first cover.

17 Claims, 6 Drawing Sheets

(56) References Cited

U.S. PATENT DOCUMENTS

| | | | | | |
|---|---|---|---|---|---|
| 4,955,466 | A | | 9/1990 | Almes et al. | |
| 5,203,800 | A | | 4/1993 | Meredith | |
| 5,250,012 | A | | 10/1993 | Meredith | |
| 5,330,401 | A | | 7/1994 | Walstead | |
| 5,688,209 | A | * | 11/1997 | Trulaske | A63B 21/154 482/54 |
| 5,709,632 | A | | 1/1998 | Socwell | |
| 5,868,648 | A | * | 2/1999 | Coody | A63B 22/02 482/51 |
| 5,891,001 | A | * | 4/1999 | Carnes | A63B 22/02 482/54 |
| 5,897,460 | A | * | 4/1999 | McBride | A63B 22/0012 482/51 |
| 6,042,514 | A | * | 3/2000 | Abelbeck | A63B 22/02 198/439 |
| 6,053,848 | A | | 4/2000 | Eschenbach | |
| 8,343,016 | B1 | * | 1/2013 | Astilean | A63B 21/156 482/54 |
| 8,864,627 | B2 | * | 10/2014 | Bayerlein | A63B 21/0053 482/2 |
| 9,005,085 | B2 | * | 4/2015 | Astilean | A63B 22/02 482/54 |
| 9,694,234 | B2 | * | 7/2017 | Dalebout | A63B 22/02 |
| 2012/0270705 | A1 | | 10/2012 | Lo | |
| 2016/0287930 | A1 | * | 10/2016 | Moser | A63B 71/0622 |
| 2016/0367851 | A1 | * | 12/2016 | Astilean | F03G 5/00 |
| 2017/0056716 | A1 | * | 3/2017 | Cutler | A63B 22/0285 |

* cited by examiner

TREADMILL WITH SUSPENDED TREAD BELT

CROSS-REFERENCE TO RELATED APPLICATIONS

This application claims priority to U.S. Provisional Patent Application No. 62/211,580 filed on Aug. 28, 2015, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to have an aerobic workout indoors. One such type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 5,709,632 issued to Jeff D. Socwell, which patent is incorporated herein by reference for all that it discloses. In this reference, a curved deck treadmill is disclosed as comprising a support frame comprising a first side and a second opposing side having a deck supportably disposed there between. In a preferred design, the deck comprises a first end, a second end, and an intermediate portion disposed between the first and second ends. The intermediate portion of the deck is preferably formed having a substantially arcuate configuration such that a significant portion of the intermediate portion may be operably disposed dimensionally lower in longitudinal relation to the first and second ends of the deck. Further, a roller assembly is provided preferably comprising a first and second roller. The first roller may be rotatably disposed contiguous the first end of the deck between the first side and the second side of the support frame. Correspondingly similar in construction and design, a second roller is preferably disposed contiguous the second end of the deck between the first and second sides of the support frame. In operation, an endless belt may be rotatably mounted in relation to the roller assembly and operatively disposed in relation to the deck, whereby providing a structurally supported arcuate shaped, movable surface on which a user may exercise.

SUMMARY

In one embodiment of the present invention, a treadmill deck includes a first side rail, a second side rail aligned with the first side rail, a first pulley connected to a first end of the first and second side rails, and a second pulley connected to a second end of the first and second side rails. A tread belt is disposed around the first pulley and the second pulley. Further, a first cover is connected to the first rail that spans at least a first portion of a first mid-region of the first rail and cantilevers over a portion of the tread belt that provides an unstable footing. Also, the tread belt moves with respect to the first cover.

A second cover may be connected to the second rail that spans at least a second portion of a second mid-region of the second rail and cantilevers over a portion of the tread belt.

The tread belt may include a first edge adjacent to the first rail and a second edge adjacent to the second rail, wherein at least a portion of an underside of the first edge and the second edge are unsupported.

An inner surface of the tread belt may be unsupported.

The first cover may cantilever over the tread belt a distance of 0.5 inches to 6.0 inches.

The first cover may cantilever over a portion of the tread belt that provides an unstable footing.

The first cover may terminate at another portion of the tread belt that provides a stable footing.

The stable footing may be generated by tension in the tread belt based on a distance between the first pulley and the second pulley.

A tension in the tread belt may provide a return spring force to impacts to the tread belt.

The tread belt may be allowed to sag when a user's body weight is applied to either the first mid-region or the second mid-region of the tread belt.

The first cover may exhibit a characteristic of having sufficient strength to support the weight of a user.

The tread belt may define a void between the first pulley and the second pulley.

The tread belt may be user powered.

In one embodiment of the invention, a treadmill includes a frame, a first side rail connected to the frame, a second side rail connected to the frame and aligned with the first side rail, a first pulley connected to a first end of the first and second side rails, a second pulley connected to a second end of the first and second side rails, a tread belt disposed around the first pulley and the second pulley, a first cover connected to the first side rail that spans at least a first portion of a first mid-region of the first side rail and cantilevers over a portion of the tread belt, a second cover connected to the second side rail that spans at least a second portion of a second mid-region of the second side rail and cantilevers over a section of the tread belt. The first cover and the second cover cantilever over portions of the tread belt that provide an unstable footing and the first cover and the second cover terminate over other portions of the tread belt that provide a stable footing.

An inner surface of the tread belt may be unsupported.

The first cover may cantilever over the tread belt a distance of 0.5 inches to 6.0 inches.

The stable footing may generated by tension in the tread belt based on a distance between the first pulley and the second pulley.

The first cover may exhibit a characteristic of having sufficient strength to support a weight of a user.

The tread belt may be user powered.

In one embodiment of the invention, a self-powered treadmill includes a first side rail, a second side rail aligned with the first side rail, a first pulley connected to a first end of the first and second side rails, a second pulley connected to a second end of the first and second side rails, a tread belt disposed around the first pulley and the second pulley, a first cover connected to the first side rail that spans at least a first portion of a first mid-region of the first side rail and cantilevers over a portion of the tread belt, a second cover connected to the second side rail that spans at least a second portion of a second mid-region of the second side rail and cantilevers over a section of the tread belt, the first cover and the second cover exhibit a characteristic of having sufficient strength to support a weight of a user, and the first cover and the second cover cantilever over the tread belt a distance of 0.5 inches to 6.0 inches. The first cover and the second cover cantilever over portions of the tread belt that provide an unstable footing and the first cover and the second cover terminate over other portions of the tread belt that provide a stable footing. An underside of the tread belt is unsupported and the stable footing is generated by tension in the tread belt based on the distance between the first pulley and the second pulley. The tread belt is allowed to sag when a user's body weight is applied to either the first mid-region or the second mid-region of the tread belt and the tension in the tread belt provides a return spring force to impacts to the tread belt.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side.

Figure 1A:
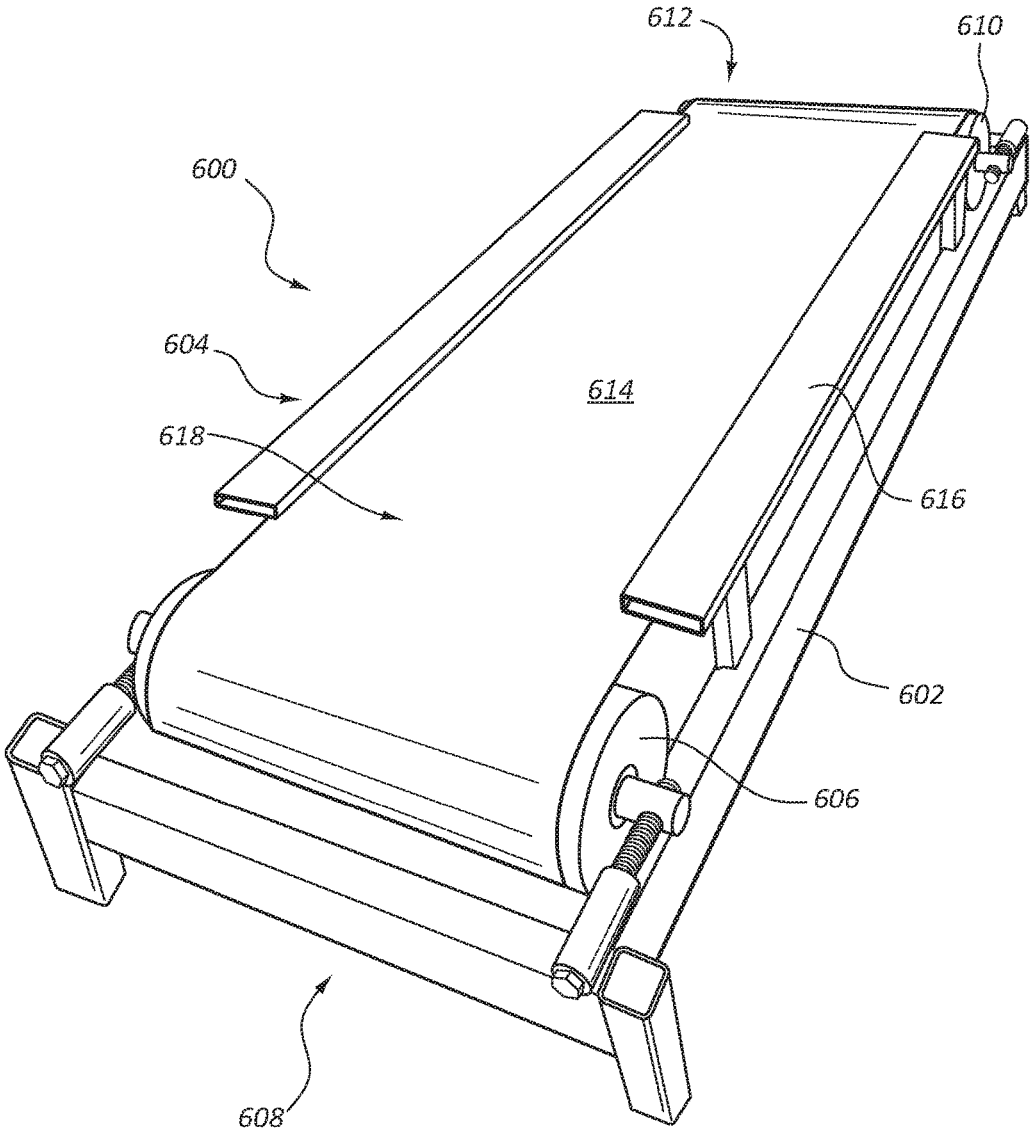
FIG. 1*a* illustrates a perspective view of an example of a treadmill in accordance with the present disclosure.

Particularly, with reference to the figures, FIG. 1*a* depicts an example of a treadmill deck 600. The treadmill deck 600 includes a first side rail 602, and a second side rail 604 aligned with the first side rail 602. The treadmill deck 600 also includes a first pulley 606 connected to a first end 608 of the first and second side rails 602, 604, and a second pulley 610 connected to a second end 612 of the first and second side rails 602, 604. A tread belt 614 is disposed around the first pulley 606 and the second pulley 610. Further, a first cover 616 is connected to the first rail 602 that spans at least a first portion of a first mid-region 618 of the first rail 602 and cantilevers over a portion of the tread belt 614 that provides an unstable footing. The tread belt 614 moves with respect to the first cover 616.

Figure 1B:
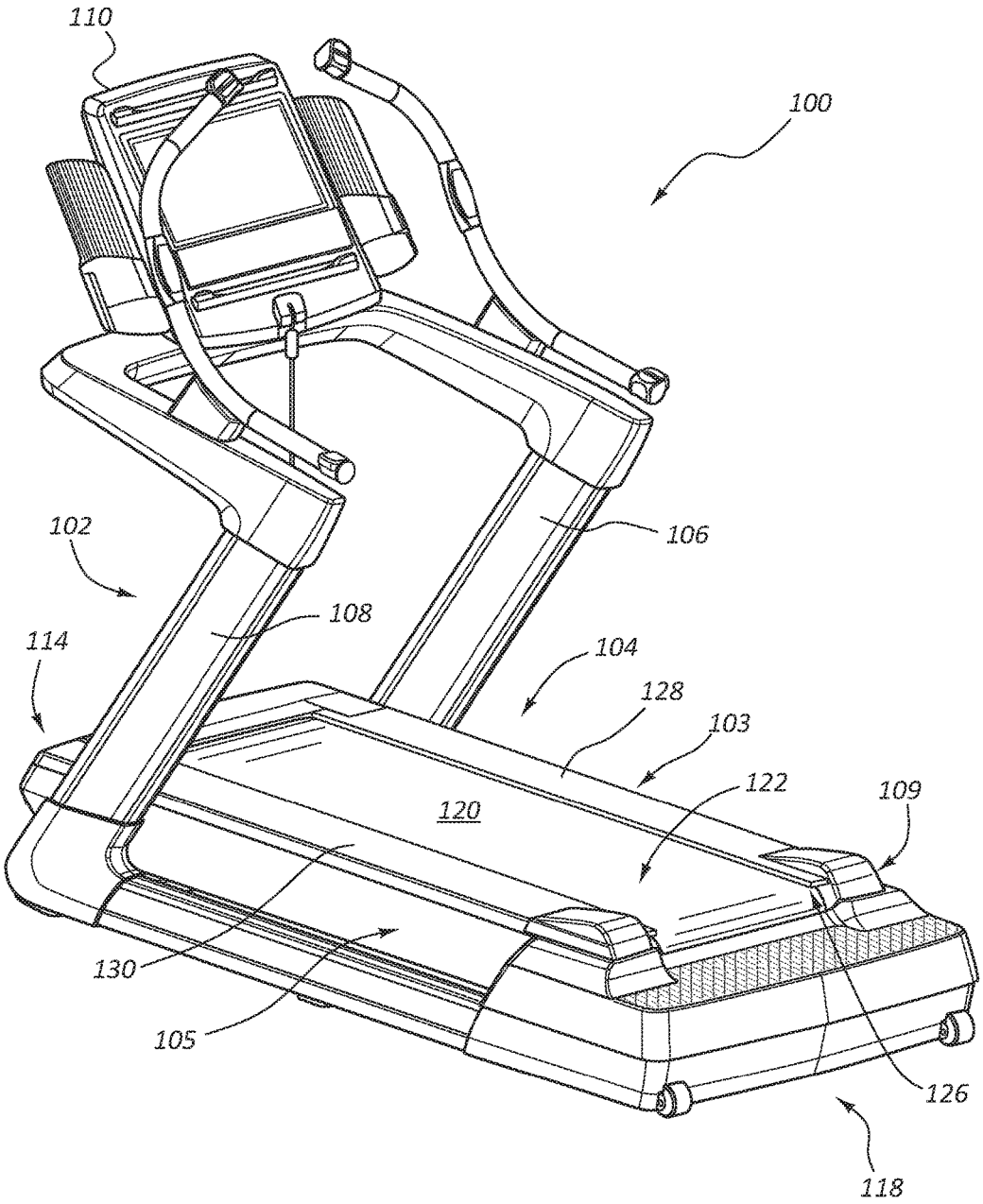
FIG. 1*b* illustrates a perspective view of an example of treadmill in accordance with the present disclosure.

FIG. 1*b* illustrates an example of a treadmill 100 in accordance with the present disclosure. The treadmill 100 includes a frame 102, and a treadmill deck 104 connected to the frame. The frame 102 includes a first post 106 and a second post 108. A console 110 is supported by the first post 106 and the second post 108.

The treadmill deck 104 comprises a first rail 103 and a second rail 105. A first pulley is located in a front section 114 of the treadmill 100 and proximate a first end 107 of both the first and second rails, 103, 105. Also, a second pulley is located in a rear section 118 of the treadmill 100 and proximate a rear end 109 of both the first and second rails 103, 105. A tread belt 120 is disposed between the first pulley and the second pulley. In this example, the distance between the first pulley and the second pulley is far enough apart that there is sufficient tension in the tread belt 120 to support a person without additional support underneath an inner side of the tread belt 120. The tension in the tread belt 120 creates a stable footing region 122 along a portion of the width of the tread belt 120. However, the tension in the tread belt 120 is not strong enough to support a person's weight near an edge of the tread belt creating an unstable footing region 126. In the unstable footing region 126, the tread belt 120 may collapse under the load of a user's body weight.

A first cover 128 is attached to the first rail 103, and a second cover 130 is attached to the second rail 105. Both the first cover 128 and the second cover 130 protrude inward over the unstable footing regions 126 of the tread belt 120 and terminate over the stable footing regions 122.

Figure 2:
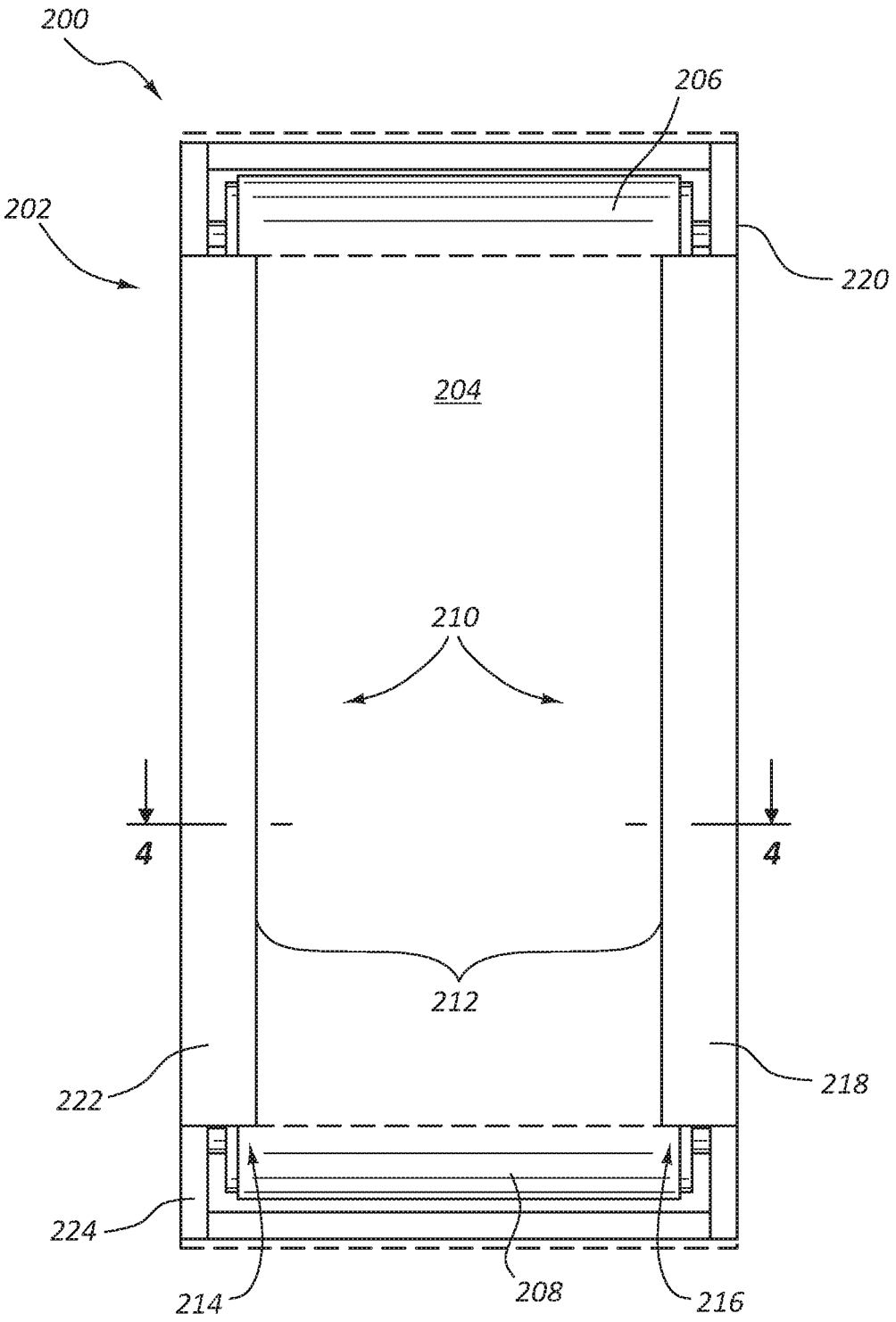
FIG. 2 illustrates a top view of an example of a treadmill in accordance with the present disclosure.

FIG. 2 depicts a top view of an example of a treadmill 200. In this example, the treadmill 200 includes a treadmill deck 202 with a tread belt 204 disposed between a first pulley 206 and a second pulley 208. The tread belt 204 comprises a stable footing region 210 in a middle portion 212 of the tread belt's width and an unstable footing region 214 along a periphery 216 of the tread belt 204. The unstable footing region 214 is obscured from view with a first cover 218 attached to a first rail 220 of the treadmill deck 202 and a second cover 222 attached to a second rail 224 of the treadmill deck 202.

Figure 3:
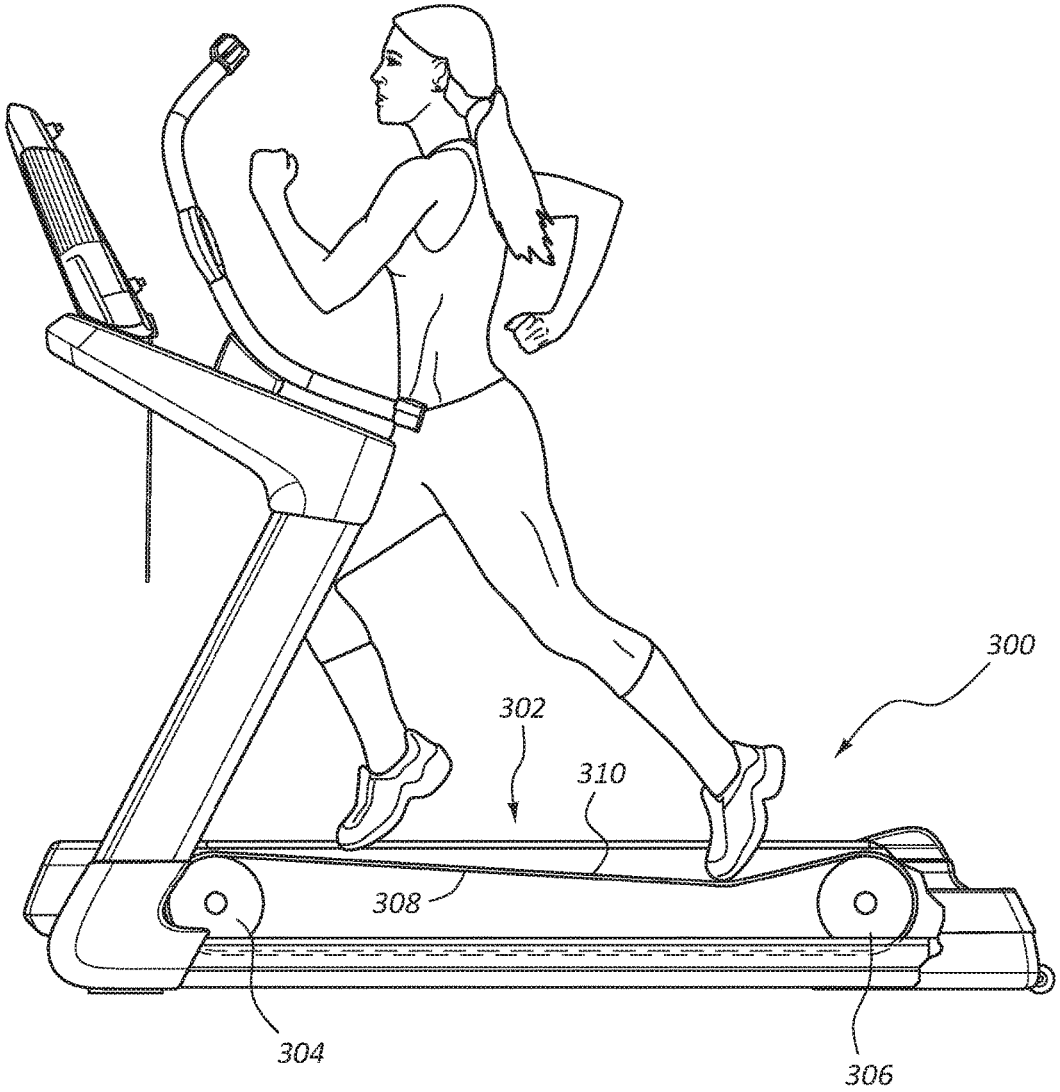
FIG. 3 illustrates a side view of an example of a treadmill in accordance with the present disclosure.

FIG. 3 depicts a side view of a treadmill deck 300. In this example, the treadmill deck 300 includes a tread belt 302 that is supported by a first pulley 304 and a second pulley 306. The tread belt 302 has an inner surface 308 and an outer surface 310. The inner surface 308 contacts the first and second pulleys 304, 306 as the tread belt 302 rotates. The user contacts the outer surface 310 as he or she exercises on the treadmill deck 300. In the illustrated example, there is no support surface positioned adjacent to the inner surface 308 of the tread belt 302. In this example, the tension in the tread belt 302 supports the user as he or she exercises on the treadmill deck 300.

Figure 4:
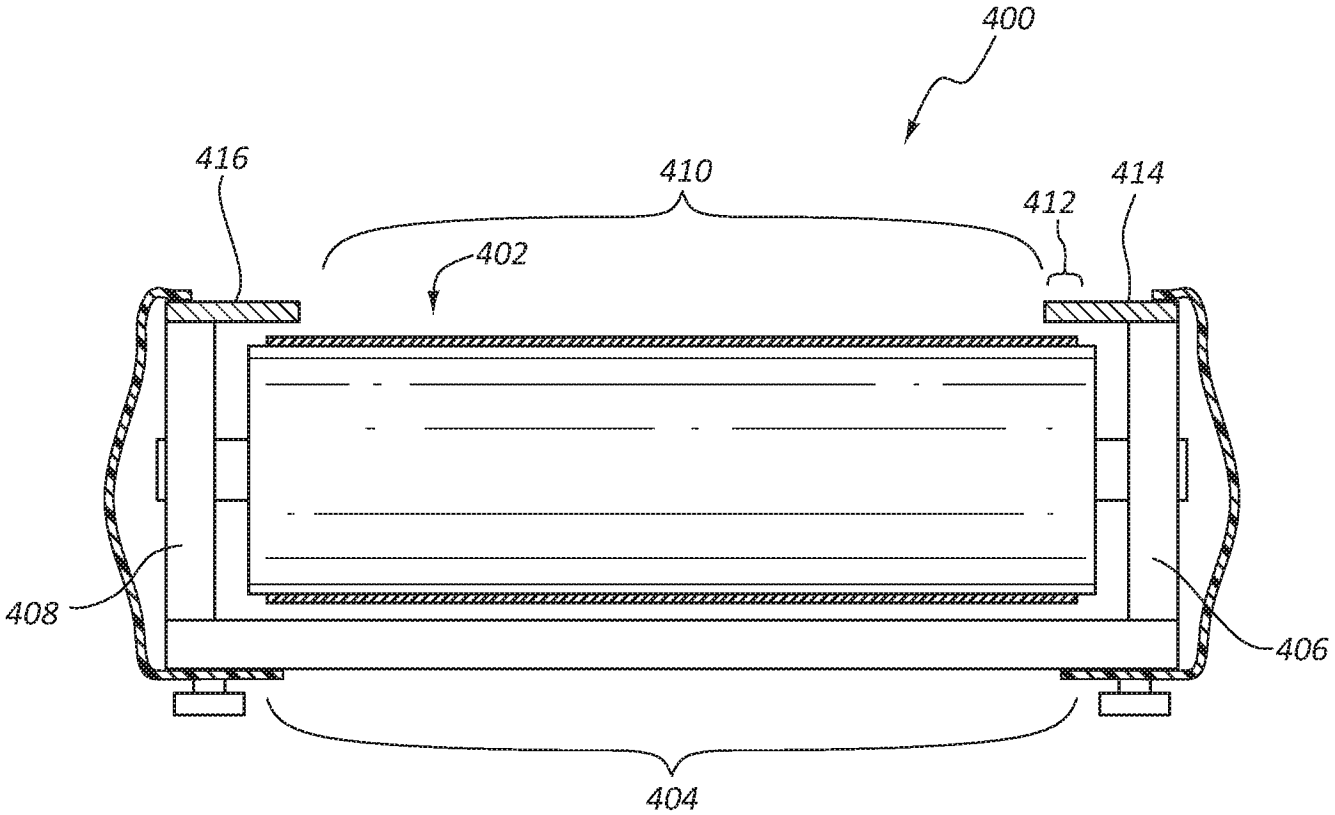
FIG. 4 illustrates a cross sectional view of an example of a treadmill in accordance with the present disclosure.

FIG. 4 depicts a cross sectional view of an example of a treadmill deck 400. In this example, the tread belt 402 spans a width 404 between the first rail 406 and a second rail 408 of the treadmill deck 400. The tension in the tread belt 402 pulls the tread belt 402 taut in a middle region 410 of the tread belt 402. In the peripheral regions 412 of the tread belt 402, the tread belt 402 is less taut. In some examples, the lower tension in the peripheral regions 412 of the tread belt 402 may led to lower foot stability.

A first cover 414 is attached to the first rail 406, and the second cover 416 is attached to the second rail 408. Each of the first and second covers 414 and 416 cantilever over the peripheral regions of the tread belt 402 where a lower amount of tension in the tread belt 402 may led to lower levels of stability. Since the first and second covers 414, 416 are connected to the first and second rails 406, 408 respectively, the covers are not connected to tread belt 402 and the tread belt 402 moves with respect to the first and second covers 414, 416.

Figure 5:
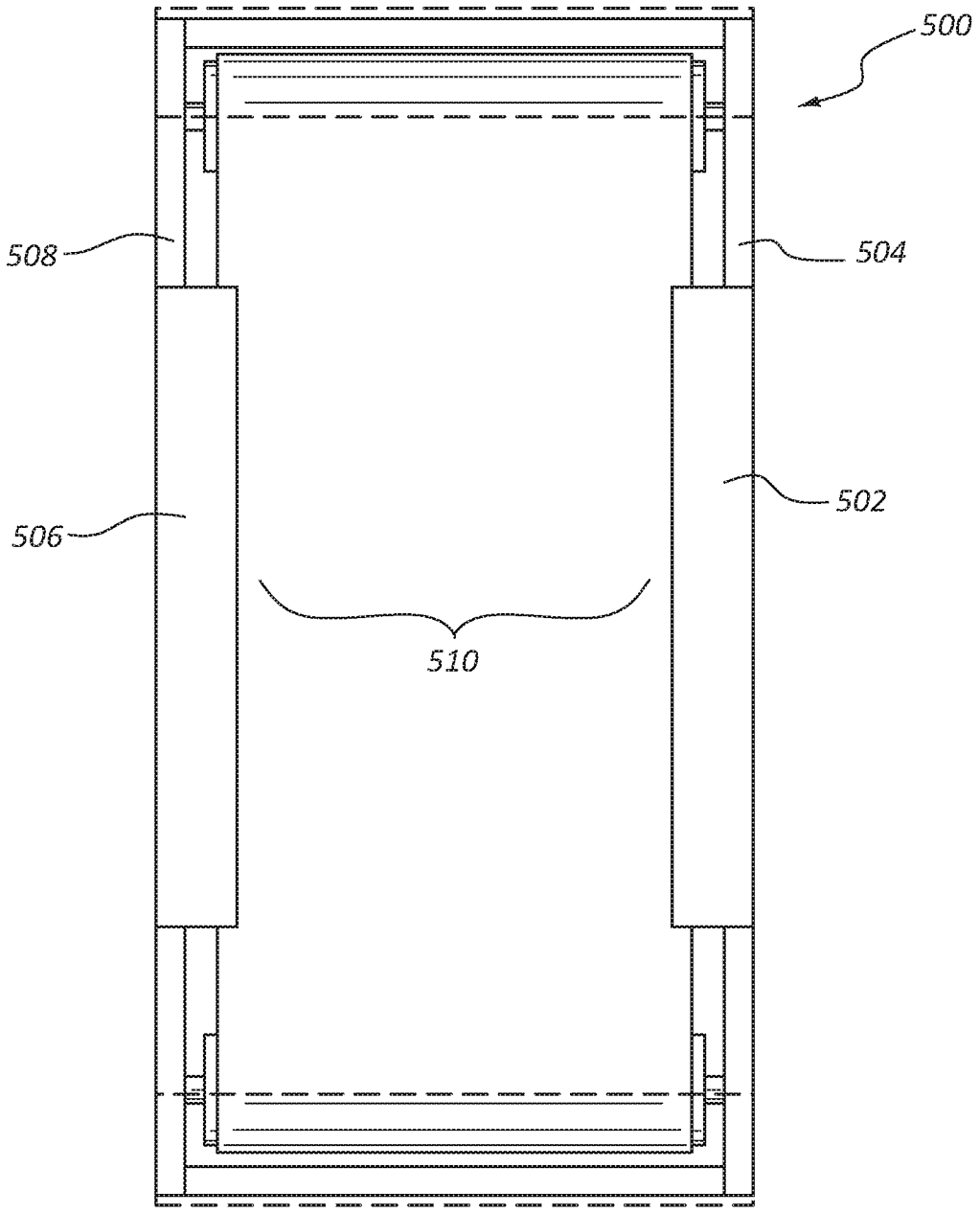
FIG. 5 illustrates a top view of an example of a treadmill in accordance with the present disclosure.

FIG. 5 depicts another top view of a treadmill 500. In this example, a first cover 502 is connected to the first rail 504, and a second cover 506 is connected to the second rail 508. Each of the first cover 502 and the second cover 506 are connected to just a mid-region 510 of the first and second rails 504, 508. Such a mid-region 510 may represent the longitudinal region of the tread belt where a user is likely to work out during the performance of an exercise on the treadmill deck.

GENERAL DESCRIPTION OF THE INVENTION

In general, the invention disclosed herein may provide the user with a treadmill with a stress reduced exercise treadmill deck. For example, conventional treadmill decks include a support surface that may be placed underneath the inner surface of a tread belt. In such a conventional treadmill, the tread belt moves across the support surface. As the user's foot contacts the tread belt, the user's foot moves with the tread belt, but the weight of the user is loaded to the support surface. The support surface generally exhibits a low level of friction with the tread belt, so that the weight of the user can be loaded to the support surface while the foot is moving with the support surface. However, in accordance with the principles described in this disclosure, no support surface is adjacent to the inner surface of the tread belt. Accordingly, there may be no support surface underneath the tread belt against which the user's weight is loaded. Instead, the weight of the user is loaded to just the tread belt. In such an example, the tread belt may be supported entirely by a front pulley and a rear pulley of the treadmill. In this circumstance, there may be void defined by the inner surface of the tread belt. As a result, the user's feet do not impact such a support surface during the performance of an exercise. As a result, the user experiences less strain on his feet, legs, knees, and joints while running or walking on the tread belt that is generally associated with running or walking on a hard surface.

While the inner surface of the tread belt is not adjacent to a support surface, the user is still supported from the tension in the tread belt. The tension in the tread belt can due to the distance between the first pulley connected to the front end of the treadmill's deck and a second pulley connected to the rear end of the treadmill's deck. Generally speaking, in conventional treadmills where a support surface is positioned adjacent an inner surface of the tread belt, the tread belt's tension is used to adjust the tread belt's alignment and prevent the tread belt from slipping. In such conventional treadmills, the support surface had a low friction surface that supported the weight of the user while allowing for relative movement between the support surface and the tread belt. In the present invention, tension may be used to additionally support the weight of the user.

In some cases, the tread belt may be made of an elastic material that stretches as the user's foot impacts the tread belt. In such an example, as the tread belt stretches, a tensile force may be generated in the tread belt that pushes the user's foot back. This may generate a bouncy feel as the user performs an exercise on the treadmill's deck. In alternative examples, at least one of the first pulley and the second pulleys is supported with a spring mechanism. In such an example, either the first or second pulley or both may be displaced as the user's foot impacts the tread belt, but the spring force of the spring mechanism returns the pulley back in place.

In some examples, the treadmill includes a treadmill deck includes a tread belt that spans between a front pulley at a front end of the treadmill and a rear pulley at a rear end of the treadmill. In such an example, the tread belt is supported just with the first and the second pulleys. The peripheral sides of the tread belt are not directly connected to side components of the tread belt and are therefore uninhibited from moving vertically as the tread belt rotates around the pulleys.

In some examples, one of the front pulley or the rear pulley may be driven by a motor, which causes the tread belt to rotate about the front and rear pulleys. In some examples, a top surface of the tread belt moves from the front pulley to the rear pulley. The speed of the tread belt can be controlled by the user or an exercise program at a pace that the user desires to walk or run. In other examples, the speed of the tread belt may be paced for riding a bicycle or another type of self-propelled exercise device on the treadmill deck.

As indicated above, the tread belt may be rotated by a motor in some examples. In such an example, a motor may be attached to either of the first pulley, the second pulley, or transmission component that connects to either the first pulley or the second pulley. As the motor rotates, the motor causes the connected pulley to also rotate. The friction between the connected pulley and the tread belt causes the tread belt and the other pulley to rotate as well. The user can adjust the speed of the tread belt though an input mechanism that sends commands to the motor to adjust the motor's speed.

In alternative examples, the tread belt may be moved by the user. As the user's foot impacts the tread belt, the tread belt may sag under the user's weight into the void defined by the inner surface of the tread belt and the first and second pulleys. Such sagging may generate a pulling force that causes the front pulley to rotate. As the user continues to impact the tread belt with his or her feet, the repetitive impacts may generate a sequence of pulling forces that cause the tread belt to rotate at a speed desired by the user. In such an example, the user can control the speed of the tread belt based on the amount of effort that the user puts into the performance of the exercise. In such situations, the distance that the user is away from the front pulley may also affect the speed of the tread belt per foot impact.

In both situations where the tread belt is moved by the motor or is driven by the user, as the user's foot impacts the tread belt, the tread belt sags under the user's weight. As the tread belt sags, the area of the tread belt around the user's foot is put into tension. Such tension may be experienced in every direction, including the area in front of the foot, the back of the foot, and the sides of the foot. Generally speaking, the region in all directions from the user's foot resists the stretching induced by the foot's impact when the user strikes the tread belt in a middle region of the tread belt's width. However, when the user's foot strikes a peripheral region of the tread belt, the region of the tread belt around the foot also resists the user's impact, but since the user is running near an edge of the tread belt the area of the tread belt near its edge does not contribute to resisting the user's impact because there may be less tread belt material to resist the tension. As a result, the user's footing in the peripheral regions of the tread belt along the tread belt's width may experience an unequal resistance to the user's foot resulting in a less stable region for the user to run. For example, in a situation where the user's foot impacts the peripheral region of the tread belt, the middle portion of the tread belt may resist the foot's impact while the distal edge of the tread belt does not contribute to resisting the tension as much as the middle portion of the tread belt. Such unequal forces along the tread belt's width may result in a force emanating from the more middle region of the tread belt outward that may cause the user's foot to roll towards an edge of the tread belt. Thus, peripheral region of the tread belt may be less stable than the regions of the tread belt that are more centrally located.

The present invention includes providing a cover over the less stable peripheral regions of the tread belt. By covering the less stable peripheral regions of the tread belt, the user may be prevented from stepping on the less stable peripheral regions. If the user's foot were to impact the cover, the user's weight would be supported by the cover as though the user had stepped on the tread belt's side rail. Such a cover may be connected directly to the treadmill's rails or the cover may be connected indirectly to the treadmill's rails through an intermediate member(s). Such covers may cantilever over the peripheral regions of the tread belt that may provide a less stable footing for the user thereby preventing the user from steeping into the tread belt's peripheral regions.

The cover may be made of any appropriate type of material that has a sufficient strength to uphold a user standing on the cover. For example, the cover may be made of a metal, wood, steel, a composite, a plastic, another suitable material, or combinations thereof. Further, the cover may protrude over the tread belt to any appropriate distance. For example, the covers may protrude at least one inch, a couple of inches, less than six inches, less than a foot, another distance, or combinations thereof. In some examples, the entire less stable region of the tread belt may be subjacent to the covers. Thus, the protruding edge of the cover terminates over a more stable region of the tread belt.

In some examples, the cover includes a protruding side, a connection side opposite of the protruding side, a front side, and a rear side opposite of the rear side. In some examples, just the connection side may be attached to the rail. In other examples, at least one of the front side and the rear side is also attached to the rail. In other examples, either of the front side or the rear side of the cover may be attached to another component of the treadmill. The connections between the covers and the other components of the treadmill (i.e. the rails or other components) may include welding, screws, clamps, nails, other types of fasteners, adhesives, other types of connections, or combinations thereof.

The first or second cover may span the entire length of the treadmill deck. In other examples, the first or second cover may span just a subsection of the treadmill deck's length. In such an example where the covers span just a subsection of the length, the covers may be situated adjacent to a region where the user is likely to run. In some examples, the covers may be to positioned in a middle region of the treadmill deck's length. For example, the middle 50.0 percent of the treadmill's length may include the covers. In other examples, a middle 25.0 percent of the treadmill's length may include the covers.

The distance between the covers may be any appropriate width. For example, width of the tread belt may be greater than the standard width of the tread belt to provide the same available tread belt width on which the user may exercise. In other examples, the available tread belt width may be smaller than in the standard treadmill because the covers occupy a portion of the tread belt's width.

Further, in some examples, the treadmill may include a console that includes input devices to control various aspects of the treadmill. For example, such a console may include a display, at least one operations controller, a stop controller, a speaker, at least one physiological sensor, a timer, a clock, another features, or combinations thereof. The display may be used to present videos, scenery, entertainment, images, clocks, games, physiological conditions of the user, touch screen buttons, other information, or combinations thereof. The operations controller may be used to control various operating parameters of exercises performed on the treadmill. Such operating parameters may include the side to side tilt of the treadmill deck, the incline of the treadmill deck, the speed of the tread belt, the volume of the speakers, image characteristics of the display, the use of the timers, the operation of the physiological sensors, other functions, or combinations thereof. The operations controller may be controlled with an input mechanism such as a push button, a touch screen icon, a lever, a dial, a switch, a microphone, a hand gesture camera, another type of input mechanism, or combinations thereof.

The physiological sensors may track physiological information about the user such as the user's heart rate, blood pressure, oxygen saturation level, pulse, respiration, muscle condition, or other physiological conditions. In some examples, such sensors are incorporated into the console. However, in other examples, such physiological sensors are incorporated into one of the first and second arm rests. The physiological sensors may be used to monitor the health of the user which may assist the user in planning future workouts, in maintaining a target health condition during the workout, in calculating an energy expenditure value representing the amount of energy that the user expended during the workout, in performing other functions, or combinations thereof. Generating such an energy expenditure value may take into account the user's weight, age, height, gender, body composition, other personal information, or combinations thereof.

The processes for calculating the energy expenditure may be in communication with a remote device, which has access to personal information about the user. For example, the remote device may include a profile of the user which includes the user's age, weigh, height, gender, body composition, health conditions, other personal information, or combinations thereof. In some cases, the remote device includes a mobile device, a laptop, a remote computer, a server, a computing device, a data center, another type of device, or combinations thereof. Such profile information may be available to the user through an iFit program available through www.ifit.com and administered through ICON Health and Fitness, Inc. located in Logan, Utah, U.S.A. An example of a program that may be compatible with the principles described in this disclosure is described in U.S. Pat. No. 7,980,996 issued to Paul Hickman. U.S. Pat. No. 7,980,996 is herein incorporated by reference for all that it discloses. However, such profile information may be available through other types of programs. For example, such information may be gleaned from social media websites, blogs, public databases, private databases, other sources, or combinations thereof. In yet other examples, the user information may be accessible through the treadmill. In such an example, the user may input the personal information into the treadmill before, after, or during the workout.

An incline mechanism may be used to control the front to rear slope of the treadmill deck. In these cases, the slope of the exercise deck is relatively flat. However, in other examples the incline mechanism may raise or lower a front section of the treadmill to create a different slope. Any appropriate type of incline mechanism may be used to raise and/or lower either a front section or a rear section of the treadmill. Further, any appropriate type of slope may be achieved with the incline mechanism. In some examples, the front to rear slope of the exercise deck may be negative 15.0 degrees where the front section may be lower than the rear section. In yet other examples, the front to rear slope may be a positive 45.0 degrees where the front section may be higher than the rear section. In other examples, the front to rear slope angle may be between negative 45.0 degrees and positive 45.0 degrees. Further, in some embodiments, the treadmill deck may be capable of changing its side to side tilt angle.

What is claimed is:

1. A treadmill, comprising
- a first side rail;
- a second side rail aligned with the first side rail;
- a first pulley connected to a first end of the first side rail and a first end of the second side rail;
- a second pulley connected to a second end of the first side rail and a second end of the second side rail;
- a tread belt disposed around the first pulley and the second pulley; and
- a first cover connected to the first side rail, wherein the first cover spans at least a portion of a mid-region of the first side rail and cantilevers over a portion of the tread belt;
- wherein the tread belt moves with respect to the first cover,
- wherein the first cover cantilevers over a first area of the tread belt that provides an unstable footing;
- wherein the tread belt spans the distance between the first pulley and the second pulley unsupported; and
- wherein the stable footing is generated by tension in the tread belt based on a distance between the first pulley and the second pulley.

2. The treadmill of claim 1, further comprising a second cover connected to the second side rail that spans at least a portion of a mid-region of the second side rail and cantilevers over a section of the tread belt.

3. The treadmill of claim 2, wherein the tread belt comprises a first edge adjacent to the first side and a second edge adjacent to the second side rail, wherein at least an area of an underside of the first edge and the second edge are unsupported.

4. The treadmill of claim 2, wherein an inner surface of the tread belt is unsupported.

5. The treadmill of claim 1, wherein the first cover cantilevers over the tread belt a distance of 0.5 inches to 6.0 inches.

6. The treadmill of claim 1, wherein the first cover terminates at a portion of the tread belt that provides a stable footing.

7. The treadmill of claim 1, wherein tension in the tread belt provides a return spring force to impacts to the tread belt.

8. The treadmill of claim 1, wherein the tread belt sags when a user's body weight is applied to either the first mid-region of the tread belt.

9. The treadmill of claim 1, wherein the first cover exhibits a characteristic of having sufficient strength to support a weight of a user.

10. The treadmill of claim 1, wherein the tread belt defines a void between the first pulley and the second pulley.

11. The treadmill of claim 1, wherein the tread belt is user powered.

12. A treadmill, comprising
- a frame;
- a first side rail connected to the frame;
- a second side rail connected to the frame and aligned with the first side rail;
- a first pulley connected to a first end of the first side rail and a first end of the second side rail;
- a second pulley connected to a second end of the first side rail and a second end of the second side rail;
- a tread belt disposed around the first pulley and the second pulley, wherein the tread belt spans the distance between the first pulley and the second pulley unsupported;
- a first cover connected to the first side rail that spans at least a portion of a mid-region of the first side rail and cantilevers over a portion of the tread belt;
- a second cover connected to the second side rail that spans at least a portion of a mid-region of the second side rail and cantilevers over a section of the tread belt,
- wherein the stable footing is generated by tension in the tread belt based on a distance between the first pulley and the second pulley.

13. The treadmill deck of claim 12, wherein an inner surface of the tread belt is unsupported.

14. The treadmill deck of claim 12, wherein the first cover cantilevers over the tread belt a distance of 0.5 inches to 6.0 inches.

15. The treadmill deck of claim 12, wherein the first cover exhibits a characteristic of having sufficient strength to support a weight of a user.

16. The treadmill deck of claim 12, wherein the tread belt is user powered.

17. A self-powered treadmill, comprising
- a first side rail;
- a second side rail aligned with the first side rail;
- a first pulley connected to a first end of the first side rail and a first end of the second side rail;
- a second pulley connected to a second end of the first side rail and a second end of the second side rail;
- a tread belt disposed around the first pulley and the second pulley;
- a first cover connected to the first side rail that spans at least a portion of a mid-region of the first side rail and cantilevers over a portion of the tread belt;
- a second cover connected to the second side rail that spans at least a portion of a mid-region of the second side rail and cantilevers over a section of the tread belt;
- wherein the first cover and the second cover cantilever over the tread belt a distance of 0.5 inches to 6.0 inches;
- wherein the first cover and the second cover cantilever over portions of the tread belt that provide an unstable footing and the first cover and the second cover terminate over other portions of the tread belt that provide a stable footing,
- wherein an underside of the tread belt is unsupported and the stable footing is generated by tension in the tread belt based on the distance between the first pulley and the second pulley, and wherein the tread belt is allowed to sag when a user's body weight is applied to either a mid-region of the tread belt.

* * * * *